US009617679B2

(12) United States Patent
Park et al.

(10) Patent No.: US 9,617,679 B2
(45) Date of Patent: Apr. 11, 2017

(54) CLOTHES TREATMENT APPARATUS AND CONTROL METHOD THEREOF

(71) Applicant: LG ELECTRONICS INC., Seoul (KR)

(72) Inventors: Hye Yong Park, Changwon-si (KR); Kwang Hee Lee, Changwon-si (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 14/564,892

(22) Filed: Dec. 9, 2014

(65) Prior Publication Data

US 2015/0152587 A1 Jun. 4, 2015

Related U.S. Application Data

(62) Division of application No. 13/639,696, filed as application No. PCT/KR2011/002442 on Apr. 7, 2011, now abandoned.

(30) Foreign Application Priority Data

Apr. 9, 2010 (KR) ..... 10-2010-0032550

(51) Int. Cl.
*D06F 58/20* (2006.01)
*D06F 58/10* (2006.01)

(52) U.S. Cl.
CPC ..... *D06F 58/203* (2013.01); *D06F 58/10* (2013.01); *D06F 58/20* (2013.01)

(58) Field of Classification Search
CPC ..... D06F 39/008; D06F 39/02; D06F 39/026; D06F 39/14; D06F 35/008; D06F 29/00; D06F 29/005; D06F 37/28; D06F 58/20; D06F 58/10; D06F 58/208; D06F 58/203
See application file for complete search history.

(56) References Cited

U.S. PATENT DOCUMENTS

| | | | |
|---|---|---|---|
| 3,267,701 | A | 8/1966 | Mandarino |
| 3,670,425 | A | 6/1972 | Benjamin et al. |
| 5,724,837 | A | 3/1998 | Shin |
| 6,604,297 | B2 | 8/2003 | Hagemann et al. |
| 6,713,024 | B1 | 3/2004 | Arnell et al. |
| 7,137,211 | B2 | 11/2006 | Johnson et al. |
| 2003/0126691 | A1 | 7/2003 | Gerlach et al. |
| 2005/0016012 | A1 | 1/2005 | Yang et al. |
| 2005/0050762 | A1 | 3/2005 | Hood et al. |

(Continued)

FOREIGN PATENT DOCUMENTS

| | | | |
|---|---|---|---|
| CN | 1648319 | A | 8/2005 |
| CN | 2837347 | Y | 11/2006 |

(Continued)

*Primary Examiner* — Kenneth Rinehart
*Assistant Examiner* — Tavia Sullens
(74) *Attorney, Agent, or Firm* — Dentons US LLP

(57) ABSTRACT

A clothes treatment apparatus includes a cabinet configured to define an accommodating space where clothes are accommodated, an air supply device configured to supply air to the accommodating space of the cabinet, an aroma treating part configured to perform aroma treatment toward the accommodating space, and a control part configured to control the air supply device and the aroma treating part. An aroma effect may be given to clothes treated in the clothes treatment apparatus.

3 Claims, 13 Drawing Sheets

(56) References Cited

U.S. PATENT DOCUMENTS

| | | | |
|---|---|---|---|
| 2005/0120757 | A1 | 6/2005 | Jackson |
| 2007/0193058 | A1 | 8/2007 | Zarembinski |
| 2008/0134698 | A1 | 6/2008 | Cho et al. |
| 2009/0178295 | A1 | 7/2009 | He et al. |
| 2009/0241367 | A1 | 10/2009 | Yoo et al. |

FOREIGN PATENT DOCUMENTS

| | | | | | |
|---|---|---|---|---|---|
| CN | 201172761 | Y | | 12/2008 | |
| DE | 7439405 | U | | 6/1976 | |
| DE | 3727570 | A1 | | 3/1989 | |
| DE | WO 2009022223 | A2 | * | 2/2009 | ..... D06F 39/026 |
| GB | 2231944 | A | | 11/1990 | |
| GB | 2441777 | A | | 3/2008 | |
| JP | 06-058950 | A | | 3/1994 | |
| JP | 2006-130157 | A | | 5/2006 | |
| KR | 20-165264 | A | | 10/1999 | |
| KR | 10-2006-0013797 | A | | 2/2006 | |
| KR | 20090105083 | A | | 10/2009 | |
| WO | 2008-012613 | A2 | | 1/2008 | |

* cited by examiner

CLOTHES TREATMENT APPARATUS AND CONTROL METHOD THEREOF

This application is a divisional application of U.S. patent application Ser. No. 13/639,696, filed on Oct. 5, 2012, which is a National Stage Entry of International Application No. PCT/KR2011/002442, filed Apr. 7, 2011, and claims the benefit of Korean Application No. 10-2010-0032550, filed on Apr. 9, 2010, each of which is hereby incorporated by reference for all purposes as if fully set forth herein.

TECHNICAL FIELD

The present invention is relating to a clothes treatment apparatus, more particularly, to a clothes treatment apparatus which has an aroma effect given to clothes treated therein.

BACKGROUND ART

Recently, various types of clothes treatment apparatuses as well as washing machines capable of washing clothes have been developed and used.

For example, there have been developed drum type dryers capable of drying washed clothes, cabinet type dryers capable of drying clothes hung therein and cabinet type refreshers capable of refreshing clothes by using heated air supplied to the clothes. Here, the term 'refresh' means a process in which wrinkle removing and deodorizing are performed by supplying heat and water elements to clothes.

The refresher or the dryer out of the clothes treatment apparatuses usually uses a heater to heat air to supply heated air to clothes. Such a heater may be categorized into a gas type heater which combusts gas to heat air and an electric type heater which heats air by using electrical resistance. Electric type heaters having a simple structure and easy installation structure have been popular recently.

However, if air is heated by the electric type heater, a high temperature heat of the heater might be transmitted to the clothes directly to damage to fabric of the clothes or fires might occur in the clothes treating apparatus. In addition, the electric type heater heats air by using electricity and electricity consumption will be increased to heat the air up to a desired temperature. Because of that, maintenance expenses might be increased.

In the meanwhile, in case of the clothes treatment apparatus described above, hot air is supplied to an accommodating space where clothes are held and the clothes are treated. Preferably, the hot air supplied to the accommodating space is circulated and re-heated to improve treating efficiency. After that, the re-heated air is re-supplied to the accommodating space to treat the clothes, which is a circulation system.

Such the clothes treatment apparatuses are simplified to have only the drying and wrinkle removal functions. Because of that, the user desiring various functions cannot be provided with product satisfaction and there have been increasing demands for taking actions for this deterioration of the user satisfaction.

DISCLOSURE OF INVENTION

Technical Problem

To solve the problem described above, an object of the present invention is to provide a clothes treatment apparatus which has an aroma effect given to clothes treated therein.

Solution to Problem

To achieve these objects and other advantages and in accordance with the purpose of the invention, as embodied and broadly described herein, a clothes treatment apparatus includes a cabinet configured to define an accommodating space where clothes are accommodated; an air supply device configured to supply air to the accommodating space of the cabinet; an aroma treating part configured to perform aroma treatment toward the accommodating space; and a control part configured to control the air supply device and the aroma treating part.

Advantageous Effects of Invention

According to the clothes treatment apparatus according, an aroma effect is given to the treated clothes and convenience may be given to a user. As a result, product satisfaction may be enhanced advantageously.

BRIEF DESCRIPTION OF DRAWINGS

The accompanying drawings, which are included to provide a further understanding of the disclosure and which are incorporated in and constitute a part of this application, illustrate embodiment(s) of the disclosure and together with the description serve to explain the principle of the disclosure.

In the drawings.

BEST MODE FOR CARRYING OUT THE INVENTION

Reference will now be made in detail to the specific embodiments of the present invention, examples of which are illustrated in the accompanying drawings. Wherever possible, the same reference numbers will be used throughout the drawings to refer to the same or like parts.

This specification embodies a refresher configured to refresh clothes, with being capable of supplying heated air, as clothes treatment apparatus and the present invention is not limited thereto. A subject matter of the present invention may be applicable to any devices having a heat pump which will be described later. Here, 'refresh' means a process of performing wrinkle removal, deodorization, static electricity prevention and clothes warming and the like by supplying air, heated air, water, mist and steam to clothes, cloth items and the like (hereinafter, referenced to as 'clothes'). The term 'clothes' includes clothes, apparel, shoes, socks, gloves, hats and mufflers which are wearable by people and dolls, towels and beddings which useable. That is, 'clothes' includes all kinds of objects of which washing may be performed.

Figure 1:
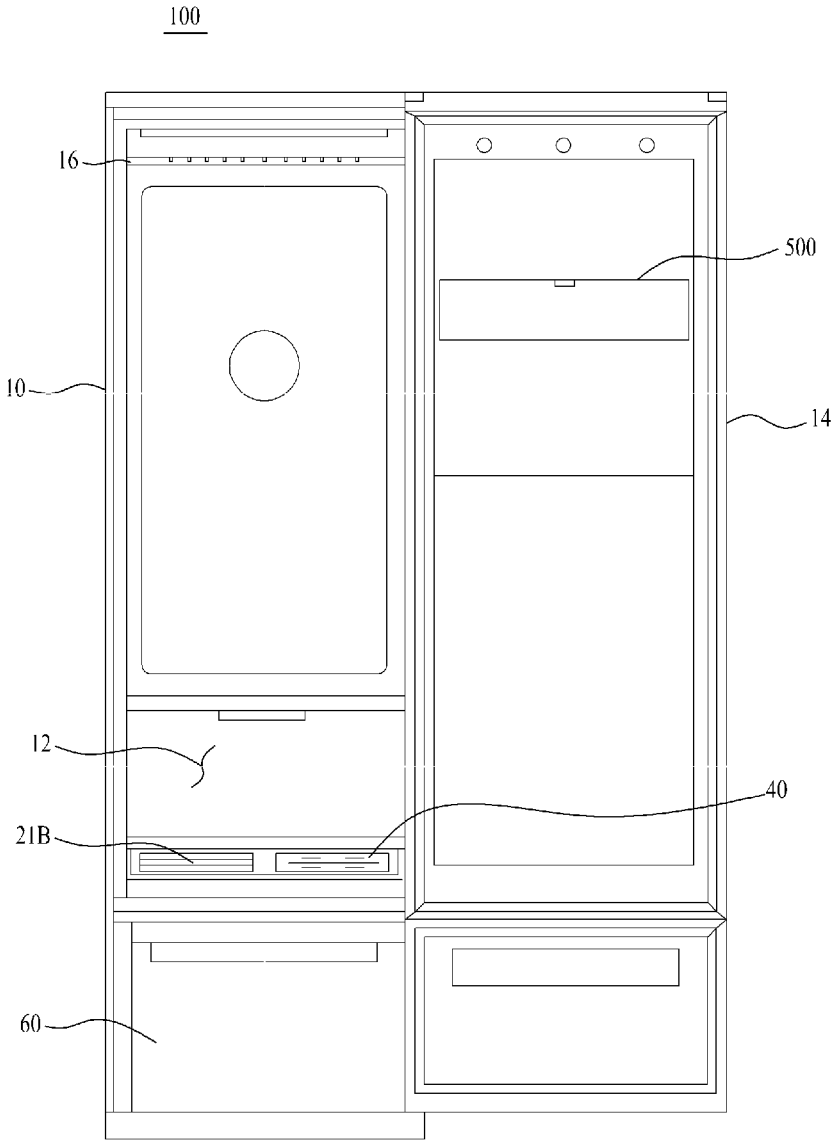
FIG. 1 is a perspective view illustrating a clothes treatment apparatus according to an exemplary embodiment of the present invention and FIG. 2 is another perspective view illustrating a clothes treatment apparatus according to an exemplary embodiment of the present invention.

In reference to FIG. 1, a clothes treatment apparatus 100 includes a cabinet 10 having a predetermined accommodating space 12 formed therein to accommodate clothes, an air supplying device (22, see FIG. 5) configured to supply air or heated air to the accommodating space 12, a moisture generating device (30, see FIG. 2) configured to spray water, mist or steam to the accommodating space 12 selectively, and a control part (not shown) configured to control the air supplying device 22 and the moisture generating device 30.

A variety of components, which will be described later, are provided in the cabinet 10 and the accommodating space 12 is formed in the cabinet 10 to accommodate clothes therein. The accommodating space 12 is selectively in communication with an outside by a door 14. Various supporters 16 may be provided in the accommodating space 12 to hang clothes thereon. The supporters 16 are configured to stand still or to maintain a fixed state to keep the clothes motionless. Here, the supporters may be configured to apply predetermined movement to the clothes when air, heated air, water, mist or steam is supplied to the clothes, which will be described later. In reference to FIGS. 2 and 3, this configuration will be described as follows.

Figure 2:
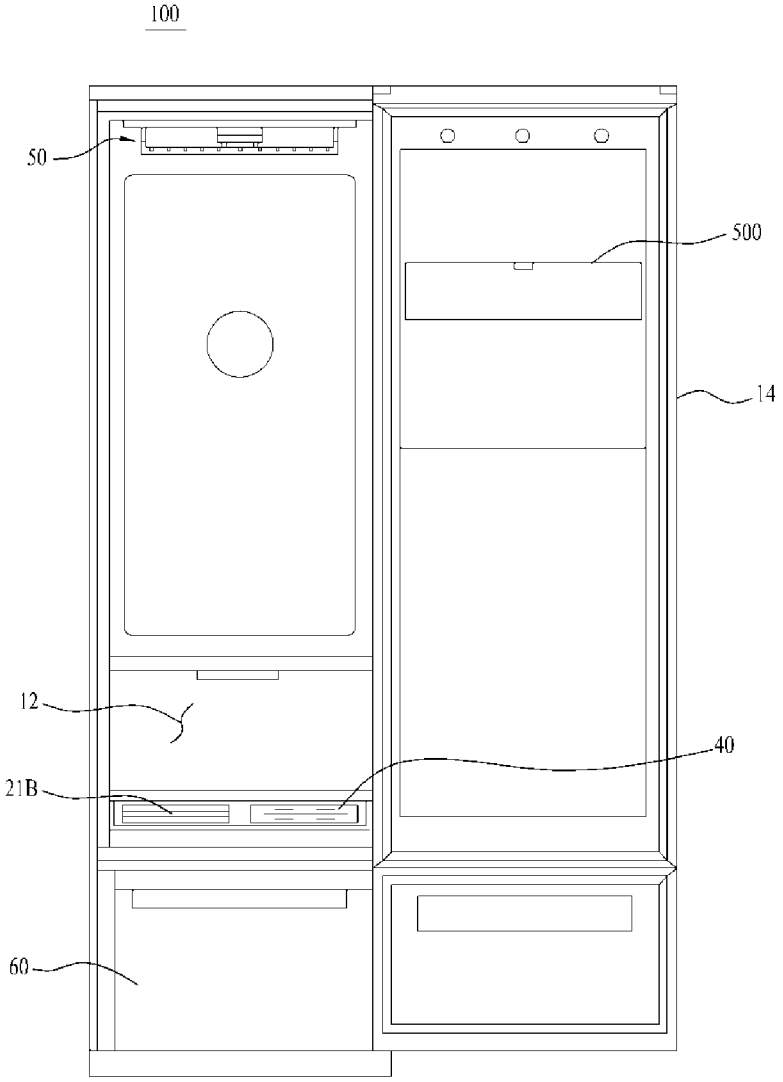

FIG. 2 is a front view illustrating a clothes treatment apparatus according to another embodiment of the present invention. Compared with the above embodiment, the clothes treatment apparatus according to this embodiment includes a moving hanger configured to apply a predetermined motion to clothes hung thereon. As follows, this difference will be described in detail.

In reference to FIG. 2, clothes are hung on a moving hanger 50 provided in the accommodating space 12 and the moving hanger 50 is configured to apply a predetermined motion to the clothes hung thereon. If the predetermined motion is applied to the clothes supplied air, heated air, water, mist or steam, the effect of clothes refreshing may be enhanced.

Figure 3:
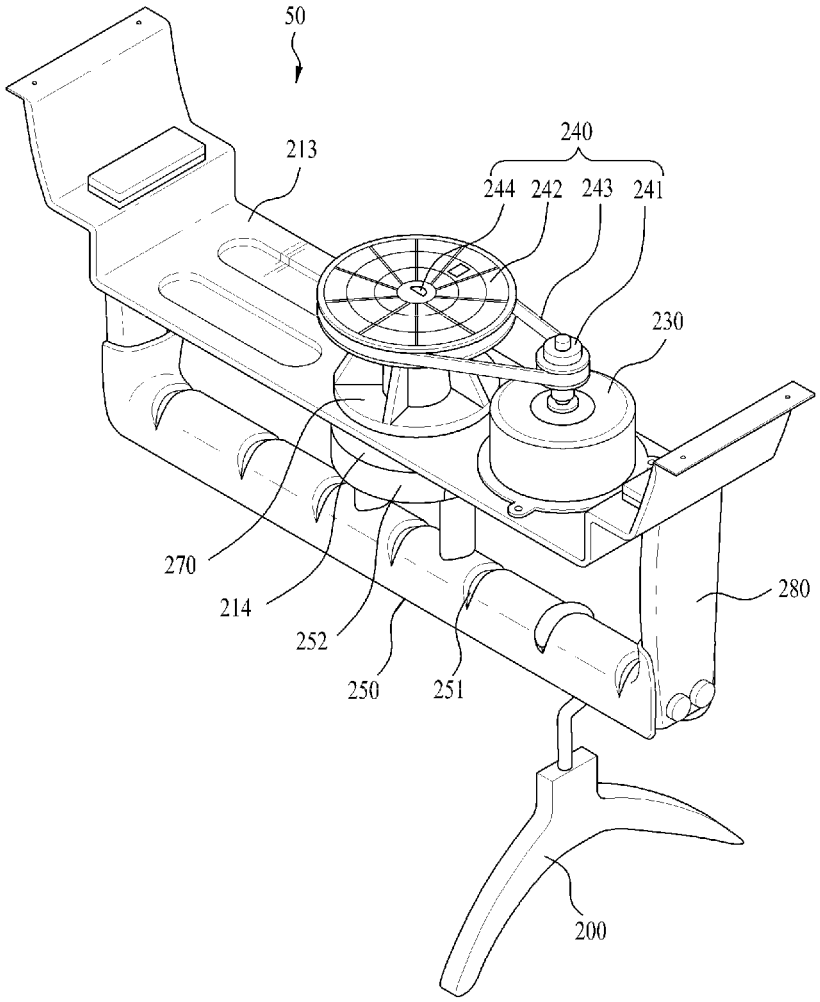
FIG. 3 is a perspective view illustrating a moving hanger of the clothes treatment apparatus according to the embodiment of the present invention.
Figure 4:
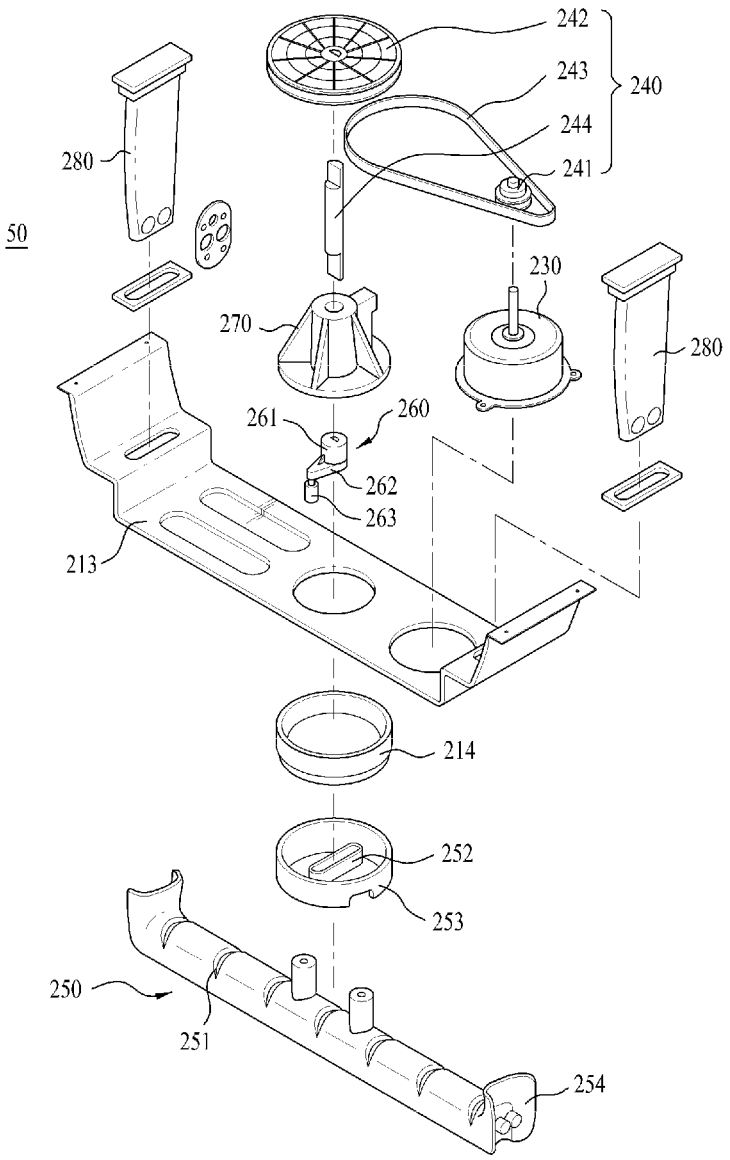
FIG. 4 is an exploded perspective view illustrating the moving hanger of the clothes treatment apparatus according to the embodiment of the present invention.

FIG. 3 is a perspective view illustrating the moving hanger 50 and FIG. 4 is an exploded perspective view illustrating the moving hanger 50.

In reference to FIGS. 3 and 4, the moving hanger 50 includes a hanger bar 250 configured to support clothes hung on a hanger 200 and a supporting part 280 configured to support both ends of the hanger bar 250. A plurality of hanger recesses 251 may be provided in the banger bar 250 to fix the location of the hanger 200 hung on the hanger bar 250. The supporting part 280 is connected to a moving hanger frame 213 and the moving hanger frame 213 is provided beyond a ceiling of the cabinet 10, not to be seen outside. Both ends of the hanger bar 250 include supporting part ribs 254, respectively, and the supporting rib 254 is covering the end of the supporting part 280.

As a result, the clothes received in the clothes treatment apparatus according to the present invention are hung on at least one hanger. Because of that, not only an improved refreshing effect but also improved drying efficiency for the clothes may be expected, compared with the conventional clothes treatment apparatus.

In the meanwhile, the moving hanger 50 includes a motor 230, a power converting part 260 configured to convert a rotational force provided by the motor 230 into a horizontally linear motion of the hanger bar 250, and a power transmitting part 240 configured to transmit the power generated from the motor 230 to the power transmitting part 260.

The power transmitting part 240 includes a driving pulley 241 provided in the motor 230, a driven pulley 242 connected to the driving pulley 241 by a belt 243, and a shaft 244 coupled to a center of the driving pulley 242. The shaft 244 may be rotatably provided in a bearing housing 270 provided in the moving hanger frame 213.

The hanger bar 250 may further include a slot 252 which lies at right angles to its longitudinal direction. Specifically, a slot housing 253 is provided on the hanger bar 250 and the slot 252 is located approximately in a center of the slot housing 252. The power converting part 260 may include a slot inserting portion 263 inserted in the slot 252, a shaft connecting portion 261 connected to the shaft 244 and a rotation arm 262 connecting the slot inserting portion 263 and the shaft connecting portion 261 with each other. The power converting part 260 is covered by a cover 214 not to be seen outside and the cover 214 is provided between the moving hanger frame 213 and the slot housing 253.

Under this configuration, when the motor 230 is rotated, the driving pulley 242 is rotated and the shaft 244 coupled to the driving pulley 242 is rotated. At this time, the slot inserting portion 263 will perform a circular motion, with a predetermined diameter.

Here, the slot 252 provided in the hanger bar 250 may be orthogonal to the longitudinal direction of the hanger bar 250. By extension, the length of the slot 252 is larger than a rotational locus of the slot connecting portion 263. Because of that, the slot 252 may perform a linear motion along a horizontal direction even when the slot inserting portion 263 performs a circular motion.

In the meanwhile, a mechanism chamber 20 configured to accommodate the air supplying device 22 and the moisture generating device 30 may be provided in the cabinet 10. The mechanism chamber 20 may be located below the accommodating space 12 and it includes the air supplying device 22 and the moisture generating device 30 received therein. The reason why the mechanism chamber 20 is located below the accommodating space 12 is that the heated air or steam supplied to the accommodating space 12 has a property of ascending and that the mechanism chamber 20 is located below the accommodating space 12 to supply the heated air or steam upwardly.

Figure 5:
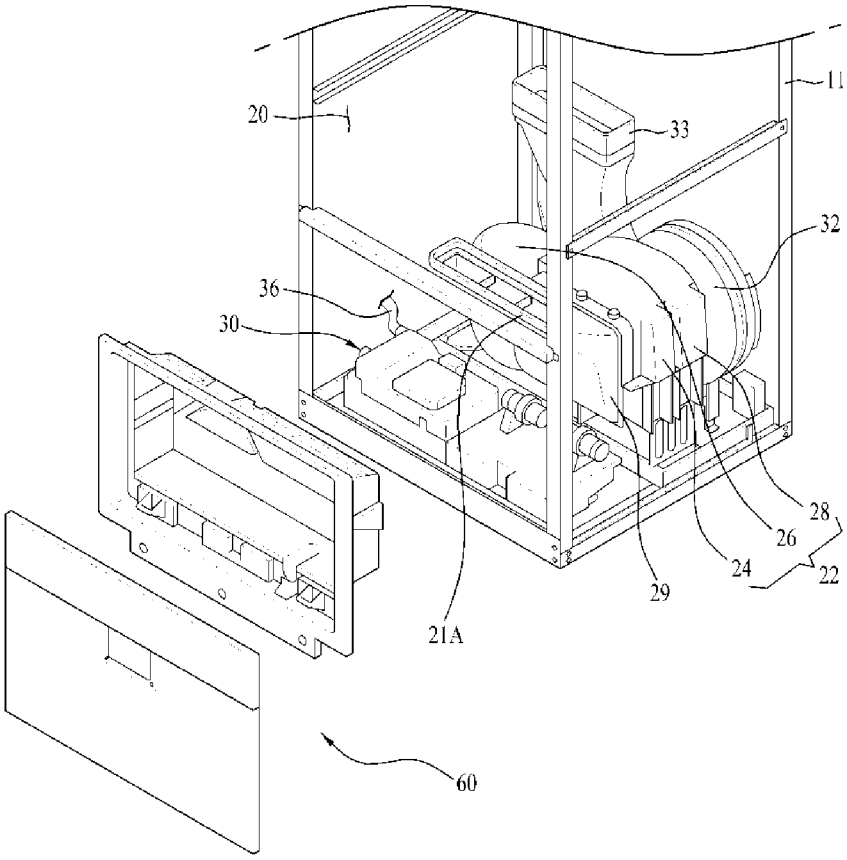
FIG. 5 is a perspective view illustrating a mechanism chamber of the clothes treatment apparatus according to the embodiment of the present invention.

FIG. 5 is a perspective view schematically illustrating an inner configuration of the mechanism chamber 20. To illustrate the inner configuration of the mechanism chamber 20, only a frame 11 of the cabinet 10 is shown in FIG. 5 for convenience sake. In addition, only main components including the air supplying device 22 and the moisture generating device 30 are illustrated in FIG. 5 for convenience sake and a drainage line connecting those components with each other is not illustrated.

In reference to FIG. 5, the air supplying device 22 configured to supply air or heated air to the accommodating space 12 may be located within the mechanism chamber 20.

A heat pump 22 embodied as the air supplying device according to the present invention may include an evaporator 24, a compressor 26, a condenser 28 and an expansion valve (not shown) which allow refrigerant to flow there through. Because of that, air is dehumidified and heated.

In other words, latent heat of ambient air is absorbed, while refrigerant is evaporated in the evaporator 24. After that, air is cooled and moisture contained in the air is condensed and eliminated. When refrigerant is condensed in the condenser 28 after passing the compressor 26, latent heat is exhausted toward ambient air. After that, the ambient air may be heated. As a result, the evaporator and the condenser 28 are functioned as heat exchanger. The air sucked into the mechanism chamber 20 may be dehumidified and heated while passing the evaporator 24 and the condenser 28, to be supplied to the accommodating space 12.

The air heated by the heat pump 22 has a relatively lower temperature than the air heated by a conventional electric heater. However, the air heated by the heat pump 22 may be dehumidified without using any auxiliary dehumidifying device. As a result, the air re-supplied to the accommodating space 12 by the heat pump 22 may be corresponding to 'relatively low dry air' (here, the term of low temperature' means not an absolutely low temperature but a relatively lower temperature than the temperature of conventional heated air). The clothes treatment apparatus according to the embodiment of the present invention may supply low temperature dry air to the clothes. Because of that, the clothes treatment apparatus according to the embodiment of the present invention may prevent deformity or damage which might be generated by the high temperature of heated air used in performing refreshing or drying for the clothes. That is, the air supplied by the heat pump 22 in the clothes treatment apparatus according to the embodiment of the present invention may have the lower temperature than the hot air supplied in the conventional clothes treatment apparatus but it may be dehumidified without any auxiliary dehumidifying device, to dry and refresh the clothes efficiently and smoothly.

Specifically, an air inlet (21A, see FIG. 5) is formed in a front portion of a top of the mechanism chamber 20 suck air of the accommodating space 12 into the mechanism chamber 20. An air path of the air may be formed by an inlet duct 29 configured to connect the air inlet 21A, the evaporator 24, the condenser 28 and the fan 32 with each other. The air drawn into the mechanism chamber 20 via the air inlet 21A by the inlet duct 29 may be dehumidified and heated while passing the heat pump 22. The dehumidified and heated air may be re-supplied to the accommodating space 12 via an outlet duct 33 and an air outlet 21B by a fan 32.

Here, although not shown in the drawings, a filter may be provided in the air inlet 21A. The filter provided in the air inlet 21A may filter various foreign substances contained in the air drawn into the mechanism chamber 20 from the accommodating space 12 and only fresh air can be re-supplied to the accommodating space 12.

Furthermore, the moisture generating device 30 may be provided in the mechanism chamber 20 to supply water, mist or steam (hereinafter, referenced to as 'steam') to the accommodating space 12 selectively.

The moisture generating device 30 includes a heater (not shown) configured to heat water and the water is heated to generate steam. The moisture generating device 30 supplies the generated steam to the accommodating space 12. An external water tap may be used as water supply source supplying water to the moisture generating device 30 or a water supplying tank (not shown) may be provided in a predetermined portion of the mechanism chamber 20 as water supply source.

The water supplying tank may be provided in a door module 60 detachably installed in a predetermined portion of the mechanism chamber 20. Because of that, a user may separate the water supplying tank from the mechanism chamber 20 for water refill and he or she may re-install the tank.

Also, the steam generated in the moisture generating device 30 is supplied to the accommodating space 12 via a steam hose 36 and a steam nozzle (40, see FIGS. 1 and 2). In this case, it is more preferable, as the shorter the steam hose 36 is, to prevent the temperature of the steam from being lowered or condensed while the steam moving through the steam hose 36. When the mechanism chamber 20 is located below the accommodating space 12, the steam nozzle 40 may supply steam via a top of the mechanism chamber 20 which is a bottom of the accommodating space 12.

A circulating fan (not shown) may be provided in a rear portion of the mechanism chamber 20 and the circulating fan supplies external air to the mechanism chamber 20. Because of that, the internal air of the mechanism chamber 20 may be prevented from increasing too much when the heat pump 22 and the moisture generating device 30 are put into operation.

An aroma treating part 500 is configured to add aromatic fragrance to the clothes treated in the accommodating space 12. The aroma treating part 500 may be located in an inner room formed in an accommodating space door 14 which opens and closes the accommodating space 12. However, the location of the aroma treating part 500 is not limited thereto and the aroma treating part 500 may be installed in an inner room of the cabinet 10 defining the accommodating space or any places formed in the accommodating space door 14.

In the meanwhile, a mounting space part (312, see FIG. 6) may be formed in the accommodating space door 14 (or the predetermined inner room of the cabinet 10) to install the aroma treating part 500 therein. The aroma treating part 500 is insertedly mounted in the mounting space part 312. When the aroma treating part 500 is installed in a state of being exposed, the mounting space part 312 does not have to be provided.

As follows, the aroma treating part 500 of the clothes treatment apparatus will be described in detail in reference to FIGS. 6 and 7.

An embodiment of the present invention presents the aroma treating part 500 is formed in the inner room of the accommodating space door 14, for explanation sake. However, the location where the aroma treating part 500 is installed is not limited thereto, as mentioned above.

Figure 6:
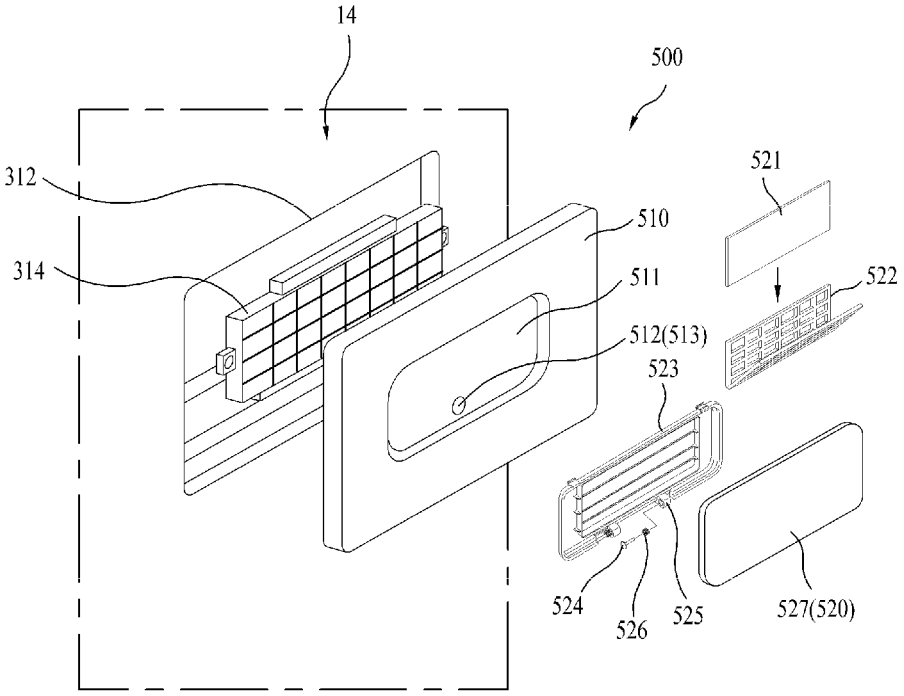
FIG. 6 is an exploded perspective view illustrating an aroma treating part according to an embodiment of the present invention.
Figure 7:
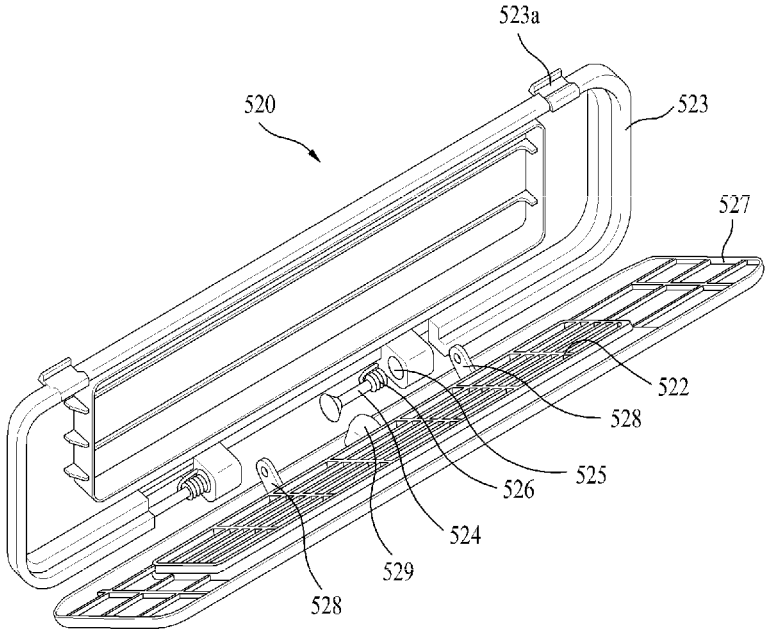
FIG. 7 is a perspective view illustrating an aroma module of the aroma treating part according to the embodiment of the present invention.

As shown in FIG. 6, the aroma treating part 500 according to the embodiment of the present invention includes a mounting part 510 mounted in the mounting space part 312 formed in the accommodating space door 14 to define a predetermined space where the aroma treating part 500 will be installed, and an aroma module 520 installed in the mounting part 510 to generate aroma.

The mounting part 510 is detachably mounted to the mounting space part 312 and the control part 314 described above may be located in an inner portion of the mounting part 510, that is, within the accommodating space door 14. A recessed portion 511 is recessed toward the inner space of the accommodating space door 14 from a center of the mounting part 510. A motor 512 configured to open and close the aroma module 520 and a driving cam 513 coupled to a rotation shaft of the motor 512 may be provided in a lower area of the recessed portion 511.

The aroma module 520 includes a body portion 523 inserted in the recessed portion of the mounting part 510, a rotational cover 527 rotatably coupled to the body portion 523 and an aroma inserting grill 522 detachably coupled to the rotational cover 527 to be exposed and closed based on the rotation of the rotational cover 527.

Here, the body portion 523 is recessed corresponding to the recessed shape of the recessed portion 511 formed in the mounting part 510 and it includes a hooking projection 523*a* formed in an outer circumferential area there to be detachably coupled to the recessed portion 511.

In addition, in a lower area of the body portion 523 may be provided a rotational shaft 524 having the rotational cover 527 rotatably coupled thereto, a rotational shaft groove 525 inserting the rotational shaft 524 thereto and a spring 526 provided in the rotational shaft 524 to apply an elastic force toward a direction of the rotational cover 527 moving to be closed.

The rotational cover 527 is rotatably coupled to a surface of the body portion 523 to form a predetermined space with the body portion 523. The rotational cover 527 has a bracket 528 and the bracket 528 is rotatably coupled to the body portion 523 by the rotational shaft 524. The aroma inserting grill 522 is detachably mounted on an inner surface of the rotational cover 527. A driven cam 529 is provided in a lower area of the rotational cover 527, corresponding to the driving cam 513 provided in the mounting part 510. When the driving can 513 is rotated at 180°, the rotational cover 527 is rotated by the operation of the driving cam 513 and the driven cam 529 along a direction in which it is open, against the elastic force applied by the spring 526. When the driving cam 513 is rotated to 360° (or 180° in an opposite direction), the rotational cover 527 is rotated by the elastic force of the spring 526 along a direction in which it is closed. The operation of the rotational cover 527 will be described in detail layer.

The aroma inserting grill 522 is formed of a pair of foldable surfaces and an aroma 521 is inserted between folded surfaces. It is preferable that the aroma 521 is configured of a thin slice of aroma 521. A mesh or a plurality of slits may be formed at each surface to exhaust aromatic fragrance of the aroma 521.

As follows, the operation of the aroma treating part according to the embodiment of the present invention will be described in detail in reference to FIGS. 8 and 9.

The aroma treating part 500 may be operable based on the control of the control part 314 or the user's manual control according to the user's setting.

Figure 8:
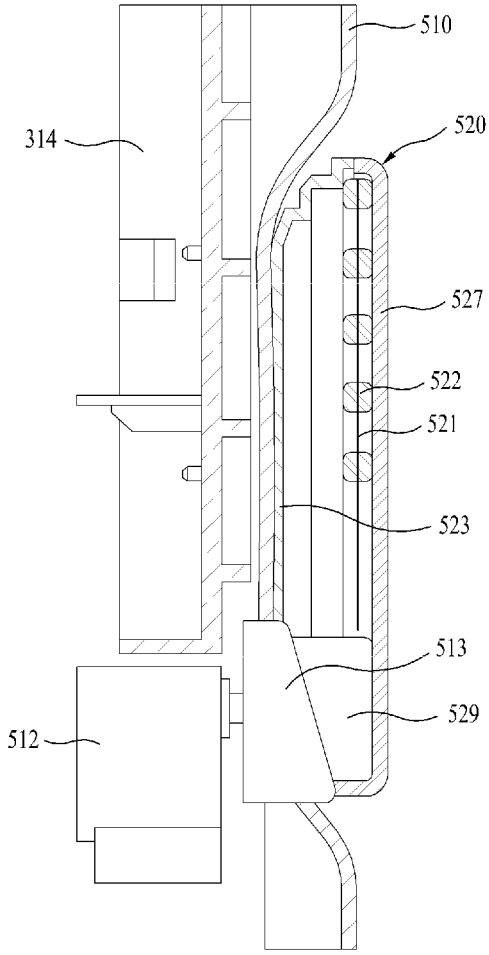
FIG. 8 is a sectional view illustrating the aroma treating part which is closed.

FIG. 8 illustrates the rotational cover 527 which is closed in close contact with the body portion 423, because the aroma treating part 500 is not put into operation. In other words, the rotational cover 527 of the aroma module 520 is rotated toward the body portion 523 by the elastic force of the spring 526 provided in the body portion 523. Because of that, a closed space is formed between the body portion 523 and the rotational cover 527. After that, the aroma 521 of the aroma inserting grill 522 mounted in the rotational cover 527 is not exhausted outside by the closed space formed between the body portion 523 and the rotational cover 527. In this case, as shown in the drawings, sectional surfaces of the driving and driven cams 513 and 529 maintain close contact with each other correspondingly.

Figure 9:
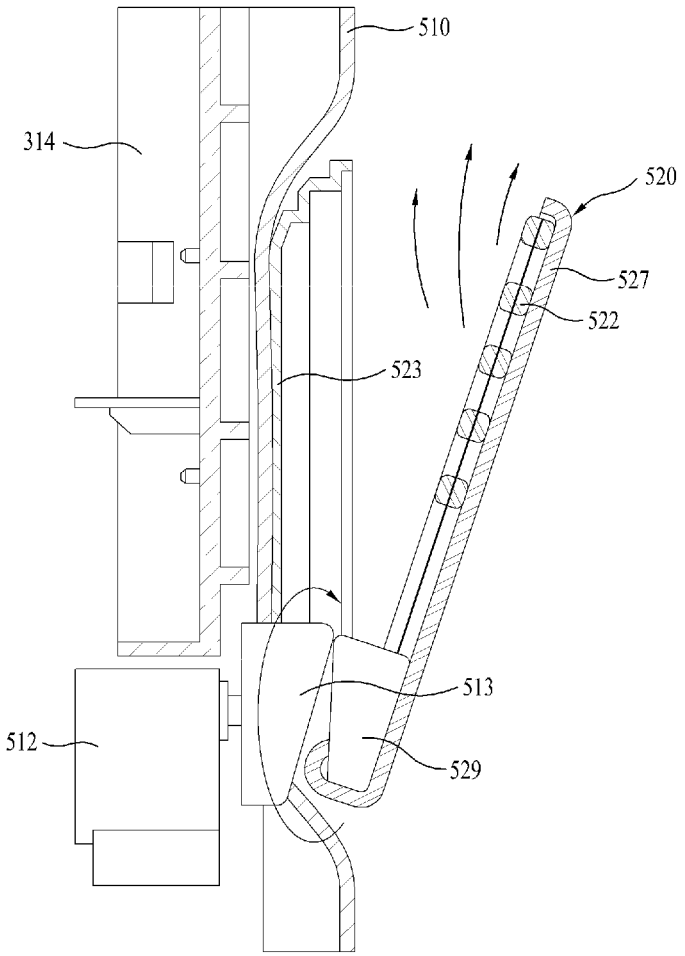
FIG. 9 is a sectional view illustrating the aroma treating part which is open.

In the meanwhile, FIG. 9 illustrates the rotational cover 527 which is open by the rotation of the motor 512. The aroma treating part 500 is put into operation and the motor is rotated then. If then, the driving cam 513 is rotated by the rotation of the motor 512. When the driving cam 513 is rotated, the sectional surfaces of the driving and driven cams 513 and 529 are not corresponding to each other, to be apart. This is because the surfaces of the driving and driven cams 513 and 529 are slope at a predetermined angle, not perpendicular to the ground, and the driven cam 529 is fixed, not rotated. As a result, when the driving cam 513 is rotated, the surface of the driving cam 513 is apart from the surface of the driven cam 529. For example, when the driving cam 513 is rotated to approximately 180° as shown in FIG. 9, a projected portion of the driving cam 513 contacts with a projected portion of the driven cam 529. as a result, the rotation of the driving cam 513 makes the driving cam 513 apart a predetermined distance from the driven cam 529 such that the rotational cover 527 connected with the driven cam 529 is rotated to be open. After that, the aroma inserting grill 522 mounted in the rotational cover 527 is open and aromatic fragrance of the aroma 521 is exhausted. The exhausted aromatic fragrance is drawn into the accommodating space where the clothes are treated and an aroma effect may be given to the clothes held in the accommodating space. In addition, when the motor 512 is re-driven to rotate the driving cam 513 to approximately 180° in the state shown in FIG. 9, the surfaces of the driving and driven cams 513 and 529 contact closely and the rotational cover 527 is closed.

Here, when replacing the aroma 521, the rotational cover 527 is open and the aroma inserting grill 522 is detached from the rotational cover 527. After that, the folded aroma inserting grill 522 is unfolded and the used aroma 521 is replaced with a new aroma 521.

As follows, another embodiment of the present invention will be described in reference to FIGS. 10 to 12.

A clothes treatment apparatus according to this embodiment has a technical characteristic that the aroma treating part can be operated accurately during the driving of the clothes treatment apparatus, if the aroma treating part is stopped abnormally by abnormal stop of the clothes treatment apparatus in an abnormal condition. For example, if the driving of the clothes treatment apparatus is stopped in an abnormal condition such as a blackout, the control part fails to recognize a state of the aroma treating part, specifically, information on opening of a rotational cover. In other words, the control part cannot recognize information about whether the rotational cover is closed or open or how much it is open. Because of that, when the clothes treatment apparatus is put into operation again after the abnormal stop, the information on the opening degree or the opening/closure of the rotational cover is not acquired and it is then difficult to control the aroma treating part accurately. As a result, the clothes treatment apparatus according to this embodiment provides a structure and method for controlling an aroma treating part accurately in re-operation thereof when its operation is stopped abnormally. Here, a sensor configured to determine whether a rotational cover is open or closed before the clothes treatment apparatus is operated and to sense a rotation angle of the rotational cover may be further provided in the clothes treatment apparatus to solve the above problem. However, in this case, there may be disadvantages of production cost increase, installation process increase and an additional logic required to control the sensor.

Compared with the above embodiment, this embodiment shown in FIGS. 10 to 12 includes restraining means configured to restrain rotation of the driving cam 513 and this difference will be described as follows.

Figure 10:
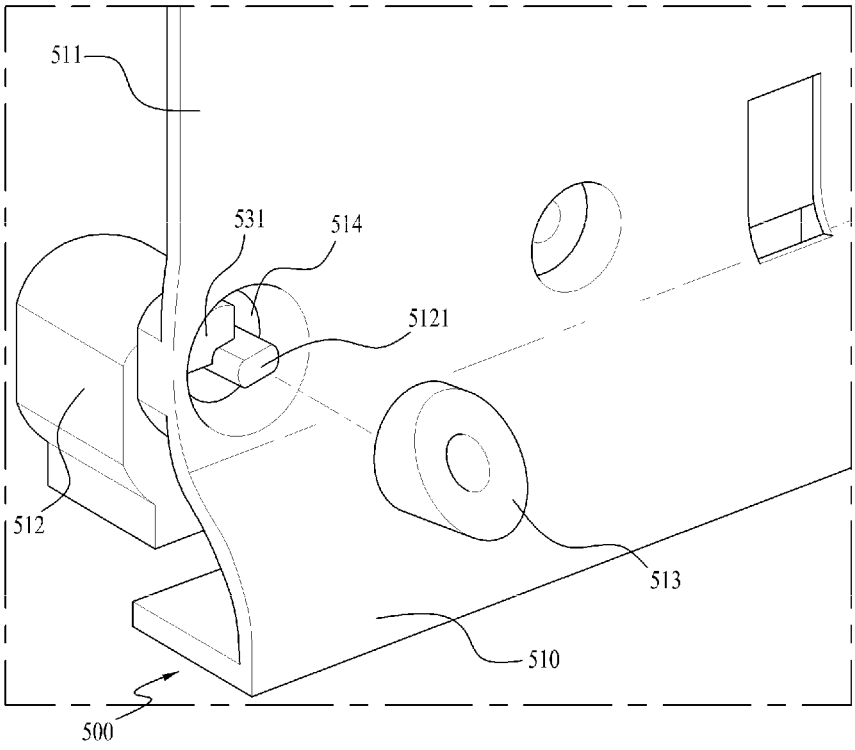
FIG. 10 is an exploded perspective view illustrating an aroma treating part according to another embodiment of the present invention.
Figure 11:
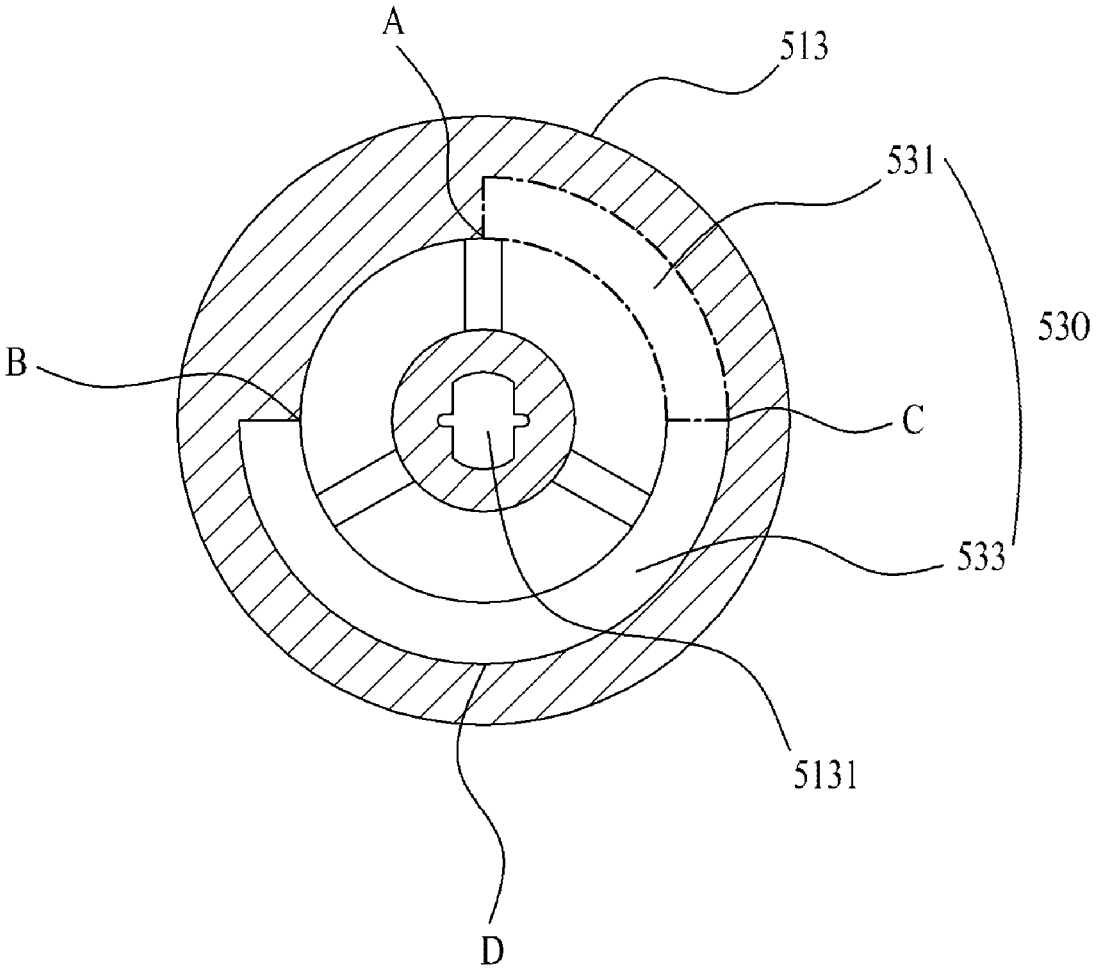
FIG. 11 is a diagram illustrating a connecting relation between a driving cam and a driving cam receiving groove.

In reference to FIGS. 10 and 11, the aroma treating part 500 according to this embodiment includes restraining means 530. In other words, the aroma treating part 500 according to this embodiment includes the mounting part 510 provided in a predetermined surface of the accommodating space 320 configured to accommodate the clothes, the aroma module 520 hingedly mounted to the mounting part to exhaust aromatic fragrance to the accommodating space selectively and restraining means 531 and 533 further provided to restrain the rotational cover of the aroma module to be rotated only within a preset range of angles. Here, the restraining means 530 may be means for locating the driving cam at a preset initial position and/or a final position accurately.

As a result, the restraining means may be a component configured to solve the above problem, without an auxiliary device such as the sensor for determining whether the rotational cover is open or closed. In this case, the driving cam is rotated during the driving of the clothes treatment apparatus in a predetermined direction. When the driving cam is located in a preset initial position, the driving cam cannot be rotated any further by the restraining means such that an initial position of the rotational cover may be identified. Moreover, the restraining means may be means enabling aroma to be supplied accurately according to a clothes treating course selected by the user, when a clothes treating course selected by the user does not require a aromatic fragrance supplying step after the abnormal condition is solved, or when a clothes treating course selected by the user is set to supply aroma to the clothes at a specific point after the clothes treatment apparatus is put into operation, for example, several minutes after a clothes treating course is implemented and several minutes before the driving of the clothes treatment apparatus is completed.

Figure 13:
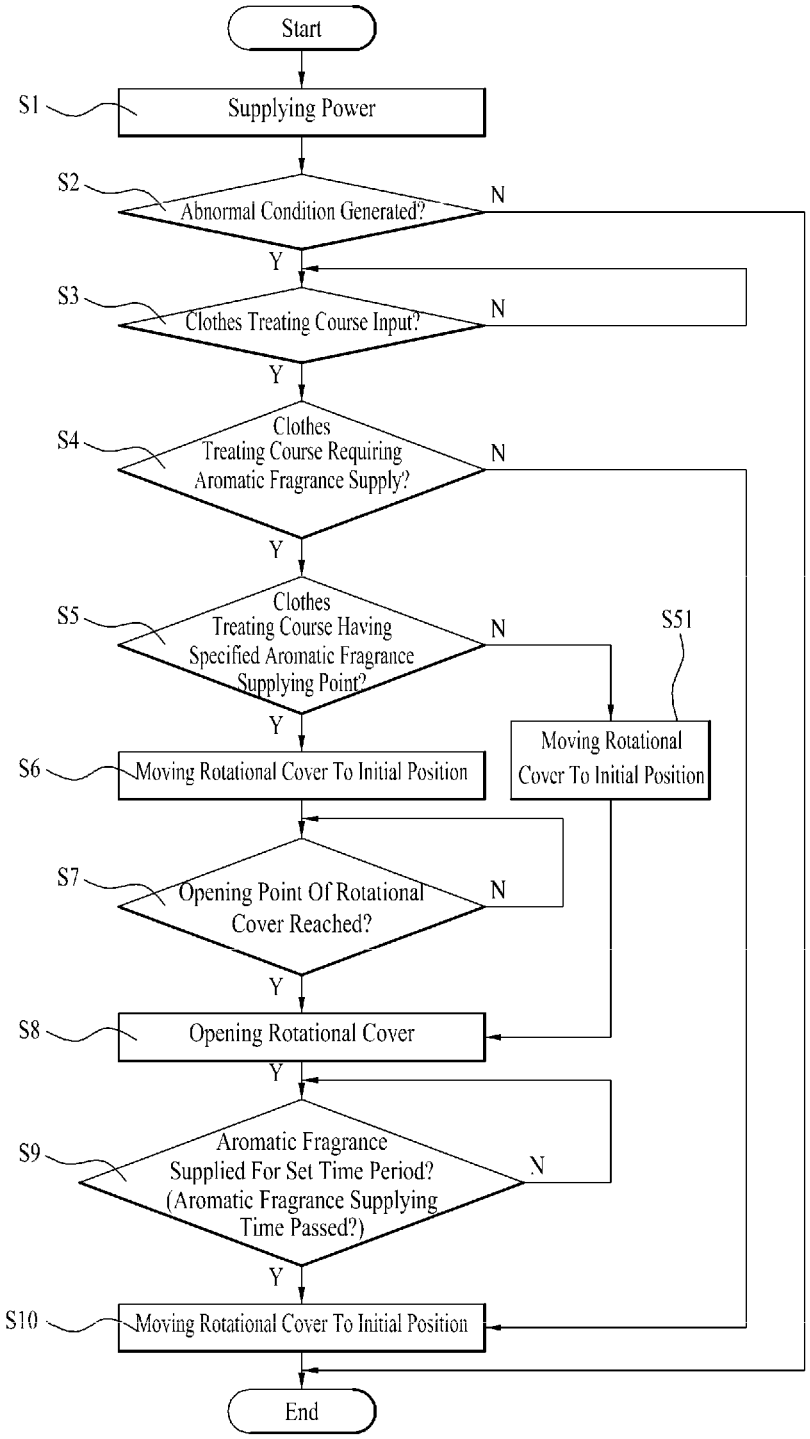
FIG. 13 is a flow chart illustrating a control method of the clothes treatment apparatus according to an exemplary embodiment of the present invention.

Here, in this case, the control part (not shown) is required to control the motor and detailed description thereof will be provided in description of FIG. 13.

FIG. 10 is an exploded perspective view partially illustrating that the driving cam 513 is separated from a rotational shaft 5121 of the motor 512 and FIG. 11 is a rear view of the driving cam 513.

In reference to FIGS. 10 and 11, the restraining means may include a projection 531 provided in a driving cam receiving groove 514 and a projection receiving groove 533 provided in the driving cam to receive the projection 531 therein. In other words, when the driving cam 513 is rotated by the rotation of the motor 512, the rotation of the driving cam 513 is restrained by the restraining means, not rotated by the rotation of the motor continuously. Specifically, when the driving cam 513 is rotated by the driving of the motor 512, a rotational angle of the driving cam 413 may be restrained by interference of the projection receiving groove 533 and the projection 531.

The rotational shaft 5121 of the motor 512 is inserted in a shaft inserting groove 5131 provided in a rear surface of the driving cam 513. In this case, the projection is insertedly received in the projection receiving groove 533. The projection 531 is an alternated long and short line in FIG. 11.

The configuration of the projection and the projection receiving groove 533 used to determine the rotational angle of the driving cam 513 may be set variously. For example, in case of an embodiment presenting that the rotational cover is open completely if the driving cam is rotated to 180°, the shapes of the projection 531 and the projection receiving groove 533 may be determined to allow the driving cam to be rotated in a range of 180 degrees or less along a clockwise or counter-clockwise direction (along a main direction or a reverse direction). That is, when the shape of the projection receiving groove 533 is provided to receive the projection 531 from A position (0°) to B position (270°) as shown in FIG. 11, the shape of the projection 531 may occupy a corresponding length of a circumference in a range of 0° to 90°, for example, a length of a circumference corresponding to A position to C position, to be rotatable inside the projection receiving groove 533 in a range of 180 degrees or less.

Because of that, when the position of the projection 531 shown in FIG. 11 is set to be an initial position, an end of the projection 531 may contact with A position (0°) of the projection receiving groove 533 and the other end of the projection 531 is located at C position (90°) inside the projection receiving groove 533. In this case, even if the driving cam 513 tries to rotate in a clockwise direction, the projection 531 is interfered with by the projection receiving groove 533 and the rotation of the driving cam 513 is restrained.

Here, when the driving cam 513 is rotated to 180° along a counter-clockwise direction, the end of the projection 531 is located at D position inside the projection receiving groove 533 by the rotation of the projection receiving groove 533 and the other end of the projection 531 is located at B position inside the projection receiving groove 533. When the other end of the projection 531 is located at B position of the projection receiving groove 533, the projection receiving groove 533 interferes with the projection 531 and the driving cam 513 is prevented from rotating any further in the counter-clockwise direction. In other words, the driving cam 513 reaches the final position where the driving cam 513 cannot be rotated any further along the counterclockwise direction. Because of that, when the driving cam 513 is rotated, the rotational angle of the projection 531 may be restrained by the interference between the ends of the projection 531 and the projection receiving groove 533. For example, the rotational angle of the driving cam 513 may be limited to 180° as shown in FIG. 11.

As a result, when the driving cam 513 is rotated at the initial position along a predetermined direction (either of the main and reverse directions, that is, the clockwise and counter-clockwise directions), the end of the projection receiving groove contacts with the end of the projection to prevent the driving cam from being rotated any further such that it may be determined that the driving cam reaches the final position. In the meanwhile, when the driving cam is rotated 180° along a different direction (the other one of the main and reverse directions, that is, the clockwise and counter-clockwise directions), the other end of the projection receiving groove contacts with the other end of the projection and the driving cam is prevented from rotating any further such that the control part may determine that the driving cam is located at the initial position.

In other words, the clothes treatment apparatus according to this embodiment sets the state of the rotational cover being closed as the initial position of the driving cam described above. When the driving cam is rotated at the initial position, the rotational cover may be open according to the rotational angle of the driving cam. Because of that, the clothes treatment apparatus according to this embodiment may prevent the rotational cover from being open at a smaller angle than a preset opening angle or the aroma from being exposed to the accommodating space by incomplete closure of the rotational cover. Another effect that the rotational cover is kept open If the driving of the clothes treatment apparatus is stopped by an abnormal condition, with the rotational cover being open may be embodied by the restraining means and the control part (not shown).

Figure 12:
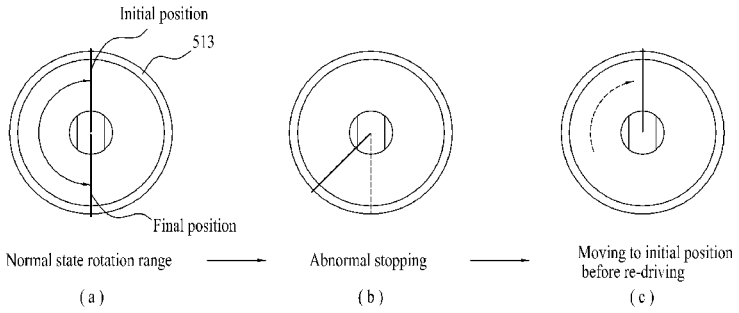
FIG. 12 is a diagram illustrating movement of the driving cam in an abnormal condition and a normal condition.

FIG. 12 is a conceptual diagram illustrating control for the driving cam 513 performed by the control part, if the rotational cover fails to reach the final position because the driving of the clothes treatment apparatus is stopped by the abnormal condition. FIG. 12 illustrates movement of the driving for explanation sake. In other words, a circular arc with an arrow shown in FIG. 12(*a*) refers to the rotational angle and rotational direction of the driving cam 513. As follows, it is assumed that the rotational angle of the driving cam 513 is limited to 180 degrees, for example, when the driving cam 513 is rotated. Moreover, when the driving cam 513 is located at the initial position, the rotational cover is closed. As the driving cam 513 is rotated further from the initial position, the rotational cover is opened. However, the present invention is not limited thereto and the rotational angle of the driving cam can be adjusted properly.

FIG. 12(*a*) illustrates that the driving cam 513 is rotated normally between the initial position and the final position normally. That is, the driving cam 513 is rotated 180 degrees between the initial position and the final position, to open and close the rotational cover.

FIG. 12(*b*) illustrates that the driving of the clothes treatment apparatus is stopped abnormally by a condition such as a blackout. In other words, the driving of the clothes treatment apparatus is stopped while the rotational cover is moving to the final position, in other words, before the rotational cover reaches the final position or it is stopped while the rotational cover is opening or getting closed. In this case, when the clothes treatment apparatus is re-operated after the abnormal condition is solved, the control part fails to recognize a state of the rotational cover, in other words, opening and closing of the rotational cover and to recognize an opening angle of the rotational cover accordingly. Because of that, there might be a control error of the aroma treating part when the user re-operates the clothes treatment apparatus, with the rotational cover maintaining the open state.

As a result, the control part of the clothes treatment apparatus according to this embodiment rotates the rotational cover along a predetermined direction, for example, the counter-clockwise direction as shown in FIG. 12(*c*) when the user re-operates the clothes treatment apparatus after solving the abnormal condition. Because of that, the driving cam 513 is rotated until the rotation thereof is restrained by the restraining means described above, in other words, until the driving cam 513 reaches the initial position. When the driving reaches the initial position, any further rotation of the driving cam is limited and the control part recognizes that the driving cam reaches the initial position. After that, the control part recognizes that the rotational cover is closed because it recognizes the driving cam is located at the initial position. When it is required to supply aroma according to the next course, the control part rotates the driving cam.

FIG. 13 is a flow chart illustrating a control method of the clothes treatment apparatus and the control method of the clothes treatment apparatus will be described in reference to FIG. 13 as follows.

First of all, the power is supplied (S1) and the control part (not shown) determines whether the clothes treatment apparatus is stopped by an abnormal condition such as a blackout just before the power supply (S2). To determine whether the driving of the clothes treatment apparatus is stopped by the abnormal condition (S2), the control part identifies an actual driving time of the clothes treatment apparatus frequently and it compares the actual driving time with an operation time preset in a clothes treating course selected by the user. Various ways capable of determining the abnormal operation stop of the clothes treatment apparatus may be applied.

When it determines that' the driving of the clothes treatment apparatus is stopped by the abnormal condition, the control part determines whether an operation command of the clothes treatment apparatus is input by the user (S3). It may be determined based on input of a clothes treating course recognized by the control part whether a re-operation command of the clothes treatment apparatus is input by the user.

After that, when the control part determines that the clothes treatment apparatus is stopped abnormally and the user inputs a new clothes treating course, the control part determines whether the new clothes treating course selected by the user requires aromatic fragrance supply with respect to the clothes (S4). The control part may store information on clothes treating course which can be selected by the user or it may receive the information from a database (not shown) storing information on the clothes treating courses. When the user inputs the new clothes treating course, the control part can determine whether the selected clothes treating course requires aromatic fragrance supply (S4).

If it determines that the clothes treating course selected by the user is a course requiring no aromatic fragrance supply, the control part may rotate the motor along the direction configured to close the rotational cover and it locates the rotational cover at the initial position. After that, each cycles set in the selected clothes treating course are implemented (S10).

However, when it determines that the clothes treating course selected by the user requires aromatic fragrance supply to the clothes, the control part determines whether an aromatic fragrance supplying point is specified in the selected clothes treating apparatus (S5). When the aromatic fragrance supplying is performed from a starting point of clothes treating course, without a specified aromatic fragrance supplying point, the control part move the rotational cover to the initial position (S51) and it controls the motor to open the rotational cover (S8) after that. Hence, the control part determines whether a predetermined time period set in the clothes treating course passes (S9). When the time period set in the clothes treating course passes, the control part closes the rotational cover to stop the aromatic fragrance supply.

When a aromatic fragrance supplying point is specified, for example, a predetermined time after the clothes treating course starts, the control part moves the rotational cover at the initial position (S6) and it determines whether a preset time for the aromatic fragrance supplying point (hereinafter, referenced to as 'waiting time') passes (S7) after that.

When the waiting time passes, the control part opens the rotational cover (S8) to supply aroma to the accommodating space and it determines whether an aromatic fragrance supplying time set in the selected course passes (S9). The control part removes the rotational cover to the initial position based on the result of the determination (S10) and it closes the rotational cover.

In the meanwhile, the control method may be varied to perform the step (S10) for moving the rotational cover to the initial position even if the input of the clothes treating course is not input (S3) after determining whether the abnormal condition is generated (S2).

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

The invention claimed is:

1. A clothes treatment apparatus comprising:

a cabinet to define an accommodating space where clothes are accommodated;

an air supply device to supply air to the accommodating space of the cabinet;

an aroma treating part to perform aroma treatment in the accommodating space; and a control part to control the air supply device and the aroma treating part, wherein the aroma treating part is provided on an inner surface of the cabinet toward the accommodating space and comprises:

a mounting part formed in the inner surface of the cabinet, the mounting part comprising:

a recessed portion recessed away from a surface of the mounting part facing the accommodating space;

a motor having a rotational shaft penetrating the recessed portion; and a driving cam coupled to the rotational shaft of the motor, an aroma module mounted on the mounting part to exhaust aromatic fragrance based on the rotation of the driving cam, the aroma module comprising:

a body portion detachably inserted in the recessed portion of the mounting part;

a rotational cover rotatably coupled to the body portion by a hinge, the rotational cover being opened and closed based on the rotation of the driving cam;

an aroma inserting grill detachably mounted on the rotational cover to be exposed and closed based on the rotation of the rotational cover, and restraining means to limit a rotational range of the rotational cover, the restraining means comprising:

a projection receiving groove provided in the driving cam; and a projection provided in the mounting part to be insertedly received in the projection receiving groove, and wherein when the driving cam rotates the rotational cover also rotates, and the rotational cover stops rotating when the projection receiving groove contacts with an end of the projection.

2. The clothes treatment apparatus of claim 1, further comprising:

a driving cam receiving groove provided in the recessed portion of the mounting part, to receive the driving cam therein, wherein the projection is provided in the driving cam receiving groove.

3. The clothes treatment apparatus of claim 1, wherein the projection receiving groove is configured to contact with one end of the projection when the rotational cover is closed and with the other end of the projection when the rotational cover is open.

* * * * *